United States Patent [19]

Biazzo et al.

[11] 4,164,678

[45] Aug. 14, 1979

[54] PLANAR AC PLASMA PANEL

[75] Inventors: Martin R. Biazzo, Holmdel; George W. Dick, Colts Neck, both of N.J.

[73] Assignee: Bell Telephone Laboratories, Incorporated, Murray Hill, N.J.

[21] Appl. No.: 914,359

[22] Filed: Jun. 12, 1978

[51] Int. Cl.[2] ..... H01J 61/30

[52] U.S. Cl. ..... 313/220; 313/188; 313/210; 313/217

[58] Field of Search ..... 313/220, 210, 188, 217

[56] References Cited

U.S. PATENT DOCUMENTS 3,811,061 5/1974 Nakagama et al. ..... 313/109.5

3,993,921 11/1976 Robinson ..... 313/188

*Primary Examiner*—Rudolph V. Rolinec

*Assistant Examiner*—Darwin R. Hostetter

*Attorney, Agent, or Firm*—Ronald D. Slusky

[57] ABSTRACT

In an ac plasma panel, row and column conductors are embedded at lower and upper levels, respectively, in a single dielectric layer on one side of the display gas. Conductive pads, arranged in rows and columns, are embedded in the dielectric layer at the upper level to provide a row and column array of display sites. Electrical signals on each lower level, row conductor are coupled capacitively to the row of pads above it.

11 Claims, 6 Drawing Figures

ALL CAPACITANCES ARE IN pf

PLANAR AC PLASMA PANEL

BACKGROUND OF THE INVENTION

The present invention relates to plasma display devices.

A plasma display device is comprised of a body of ionizable gas sealed within a nonconductive, usually transparent, envelope. Alphanumerics, pictures and other graphical data are displayed by controllably initiating and quenching glow discharges at selected locations within the display gas. This is accomplished by establishing electric fields within the gas by way of appropriately arranged electrodes, or conductors.

The present invention more particularly relates to so-called ac plasma panels in which the electrodes are insulated from the display gas. There are two basic types of ac plasma panels, twin substrate and single substrate. As described, for example, in U.S. Pat. No. 3,499,167 issued Mar. 30, 1970 to T. C. Baker et al, the former have electrodes embedded within dielectric layers disposed on two opposing nonconductive surfaces, or substrates, such as glass plates. Most commonly, the electrodes are arranged in rows on one substrate and columns orthogonal thereto on the other. The overlappings, or crosspoints, of the row and column electrodes define a matrix of display sites, or cells. Each display site can be individually switched between ON (energized, light-emitting) and OFF (de-energized, non-light-emitting) states in response to voltages applied between its electrode pair. Other twin substrate electrode arrangements, e.g., multiple segment characters, are possible.

Single substrate ac plasma panels, by contrast, have all electrodes disposed on a single one of the surfaces. As taught, for example, in my U.S. Pat. No. 3,935,494 issued Jan. 27, 1976, the electrodes may be located at different levels within the dielectric layer disposed on that one surface. With this "nonplanar" geometry, glow discharges are initiated in response to fringing fields appearing in the gas in the general region of overlapping insulated electrode pairs. Alternatively, as taught, for example, in U.S. Pat. No. 3,811,061 issued May 14, 1974 to N. Nakayama et al, electrodes of various geometries may be positioned at a single level, or plane, within the dielectric. With this "planar" geometry, discharges occur in response to fields appearing in the gas in the general region of neighboring pairs of electrodes.

More particularly, the Nakayama patent discloses a planar ac plasma panel in which row and column conductors are located at lower and upper levels, respectively, within the dielectric layer (the designations "row" and "column" being, of course, arbitrary). Conductive pads, arranged in rows and columns, are embedded in the dielectric layer at the upper level to provide a row and column array of display sites. Addressing, e.g., write and erase, signals on each lower level, row conductor are extended to the associated pads thereabove by way of ohmic, i.e., substantially resistive, paths in the form of so-called conductive vias. Disadvantageously, the inclusion of vias in the design of the panel renders the fabrication process substantially more complicated than is required for nonplanar panels, for example. In addition, the nature of the via fabrication steps tends to make uniform panel characteristics more difficult to achieve.

SUMMARY OF THE INVENTION

In accordance with the present invention, the complexities and difficulties attendant to the inclusion of conductive vias in prior art planar ac plasma panels are avoided by eliminating the vias. The function provided by the vias is achieved in accordance with the invention by fabricating the panel so as to provide substantial capacitive coupling between each row conductor and each of its associated pads. That is, the impedance between each row conductor and its associated pads is substantially capacitive. Signals on the row conductors are thus coupled to the pads capacitively, rather than ohmically as in the prior art.

In a particular embodiment of the invention disclosed herein, two row conductors are provided for each row of sites. The row conductors are arranged in first and second pluralities which are substantially parallel to and interleaved with one another. Signals are coupled capacitively to the pads of each display site in accordance with the invention from each of two associated row conductors, one from each plurality. The row conductors of each plurality are interconnected in groups such that an individual row of sites is addressed by applying appropriate signals to two row conductor groups, one from each plurality. Since row addressing signals are applied to groups of row conductors rather than individual row conductors, the number of external connections and the amount of driver circuitry needed to operate the panel is minimized.

BRIEF DESCRIPTION OF THE DRAWING

The invention may be clearly understood from a consideration of the following detailed description and accompanying drawing in which.

DETAILED DESCRIPTION

Figure 1:
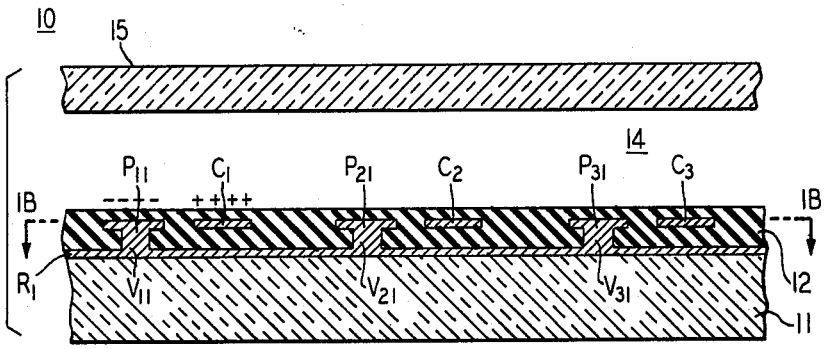
FIG. 1 (PRIOR ART)
FIGS. 1 and 2 are cross-sectional and top views, respectively, of a portion of a prior art planar ac plasma panel.
Figure 2:
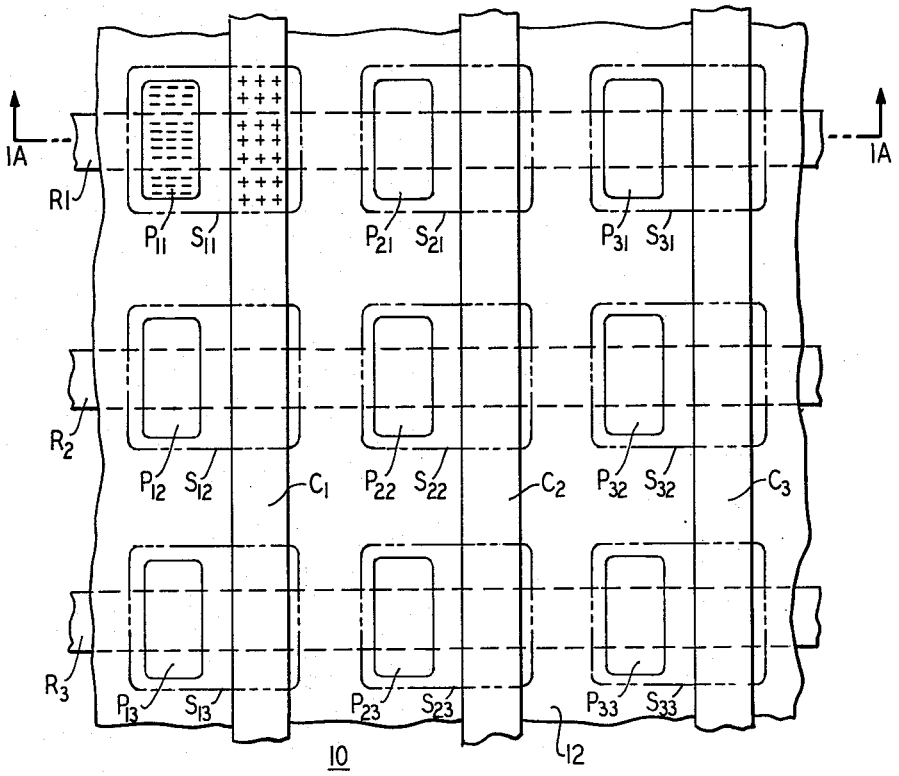
FIG. 2 (PRIOR ART)

FIGS. 1 and 2 show a portion of a planar ac plasma display panel 10 of the type described in the above-cited Nakayama et al patent. Panel 10 includes a substrate 11, which may be an eighth-inch glass plate, covered by a dielectric layer 12. (Cross-hatching of layer 12 has been eliminated in FIG. 2 for drawing clarity.) A plurality of metallic "column" conductors $C_i$, $i=1, 2 \ldots N$ are embedded at an upper level in layer 12 somewhat above substrate 11. Metallic pads $P_{ij}$, $j=1, 2 \ldots M$, arranged in a matrix array of rows and columns, are also embedded in layer 12 at the same level as conductors $C_i$. The pads $P_{ij}$ in each row are electrically connected to one another by way of vias $V_{ij}$ which connect them to an associated one of metallic "row" conductors $R_j$. The latter are embedded at a lower level in layer 12—illustratively lying on substrate 11.

Panel 10 further includes a glass cover plate 15 which is held away from the structure just described. Plate 15 is sealed around its periphery to provide a hermetic cavity within which a body of ionizable gas 14 is contained. The gas may be, for example, a mixture of neon and one-half percent argon at 500 torr.

The individual regions $S_{ij}$ in the vicinity of each pad $P_{ij}$ define a matrix of display sites, or cells. Information is displayed on the panel by creating individual glow discharges at selected sites in the display gas. This is achieved by applying appropriately timed and shaped voltage waveforms to pads $P_{ij}$ (by way of conductors $R_j$ and vias $V_{ij}$) and conductors $C_i$, illustratively under the control of a digital computer (not shown). Signal lead connections between the computer and conductors $C_i$ and $R_j$ may be made in standard fashion utilizing techniques and structures well known to those in the plasma display art.

Figure 3:
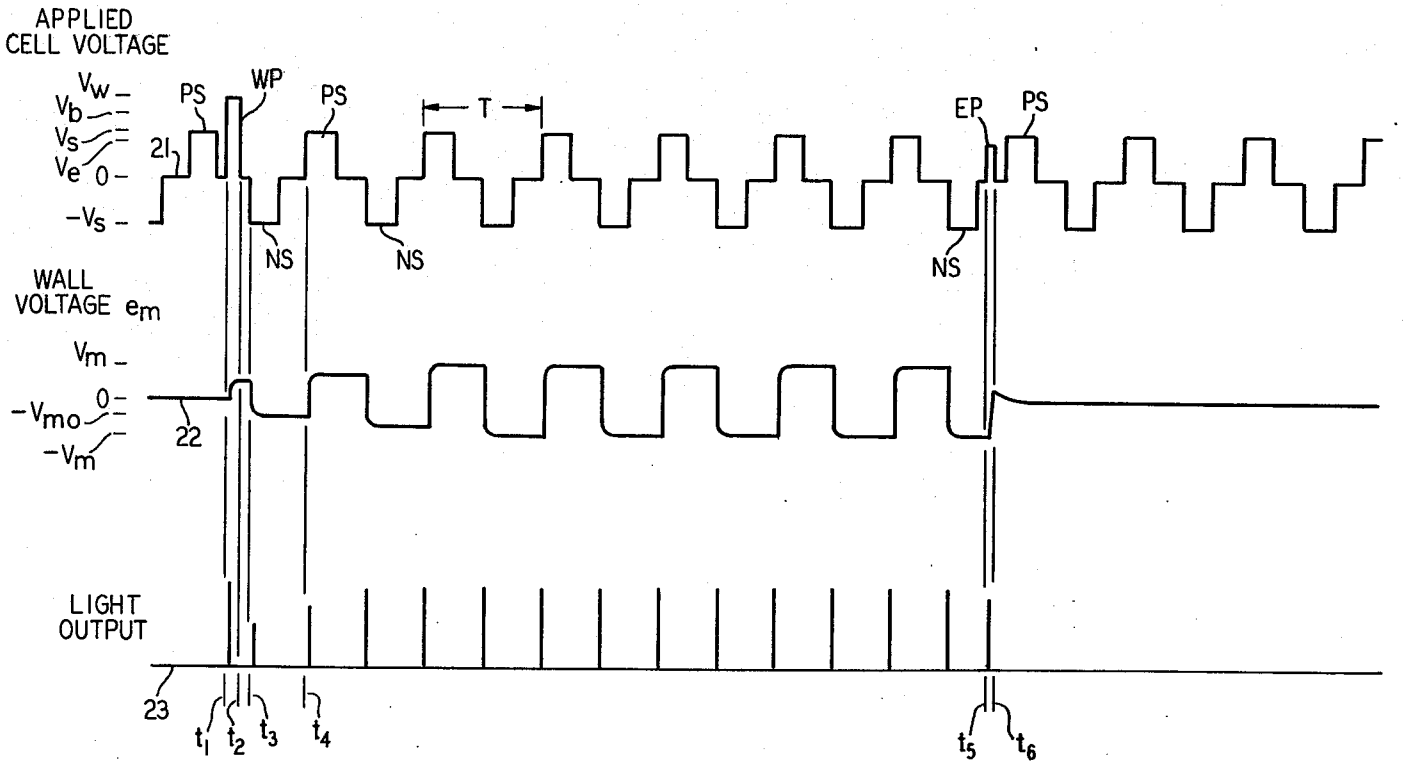
FIG. 3 depicts signal waveforms helpful in explaining the operation of the display device of FIGS. 1 and 2.

By way of example, consider display site $S_{11}$, which comprises the region in the vicinity of pad $P_{11}$ and conductor $C_1$. As indicated in waveform 21 in FIG. 3, a discharge is initiated at site $S_{11}$ by applying a write pulse WP between pad $P_{11}$ and conductor $C_1$ such as at time $t_1$. This creates an electric field within display gas 14 in the vicinity of site $S_{11}$. The magnitude $V_w$ of write pulse WP exceeds the minimum value $V_b$ necessary to ionize the gas along one or more flux paths in the vicinity of site $S_{11}$, $V_b$ being variously referred to as the "breakdown" or "striking" voltage. After a very short delay, known as the ionization time, a glow discharge characterized by a short, e.g., one microsecond, light pulse in the visible spectrum is initiated. The light pulse is represented as a narrow spike in waveform 23 of FIG. 3 occurring just after time $t_1$.

Write pulse WP may be generated by applying the voltages $+V_w/2$ and $-V_w/2$ to conductors $R_1$ and $C_1$, respectively. These two "half-select" signals are, of course, necessarily applied to all of sites $S_{i1}$ and $S_{1j}$, respectively. However, since the two potentials $+V_w/2$ and $-V_w/2$ combine only at site $S_{11}$ in this example, only that site receives a full write pulse of magnitude $V_w$ and only thereat does a discharge occur.

In addition to a light pulse, a further concomitant of a glow discharge is the creation of a space cloud of electrons and positive ions in the vicinity of the display site. Write pulse WP, which continues to be applied to site $S_{11}$, pulls at least some of these electrons and ions to the upper surface, or wall, of dielectric layer 12. As schematically indicated in FIGS. 1 and 2, the electrons are drawn to the area above pad $P_{11}$ and the ions are drawn to an area above conductor $C_1$. When write pulse WP terminates at time $t_2$, a "wall" voltage $e_m$ created by these so-called wall charge carriers remains stored at the display site, as indicated in waveform 22. This wall voltage plays an important role in the subsequent operation of the panel, as will be seen shortly.

A single short-duration light pulse cannot, of course, be detected by the human eye. In order to provide a plasma display site with the appearance of being continuously light-emitting (ON, energized), further rapidly-successive light pulses are needed. These are generated by a sustain signal which is impressed across each cell of the panel by way of its respective row and column conductor pair. As indicated in waveform 21, the sustain signal illustratively comprises a train of alternating positive- and negative-polarity sustain pulses PS and NS, respectively, which repeat every T seconds. The magnitude $V_s$ of these sustain pulses is insufficient to create a discharge. Thus, sites which have not received a write pulse remain in non-light-emitting states.

However, the electric field in the gas in the vicinity of a site which has received a write pulse, such as site $S_{11}$, comprises the superposition of the fields due to the sustain voltage and the wall voltage $e_m$ previously stored at that site. The sustain pulse which follows write pulse WP at time $t_3$ is a negative sustain pulse NS. Thus the wall and sustain fields combine additively and may be assumed to be sufficient in combination to create a second glow discharge and accompanying light pulse, occurring just after time $t_3$. The flow of carriers to the surface of layer 12 now establishes a wall voltage of opposite polarity. The arrival of the positive sustain pulse at time $t_4$ results in yet another discharge and wall voltage reversal, and so forth. The magnitude of wall voltage $e_m$ stabilizes at a nominally constant, characteristic level $V_m$ which is a function of the gas composition and pressure, electrode geometry, sustain voltage level, and other parameters. The wall voltage may attain $V_m$ immediately, i.e., in response to pulse WP, or, as shown in waveform 22, may build up to $V_m$ over one or more sustain cycles. (The principal determinants here are the magnitude, width and precise time occurrence of pulse WP.) The sustain signal frequency may be on the order of 50 kHz. Thus the light pulses of waveform 23 are fused by the eye of the viewer and site $S_{11}$ appears to be continuously energized.

Site $S_{11}$ is switched back to a non-light-emitting (OFF, de-energized) state by removing its wall charge. This is accomplished by applying an erase pulse EP to the site such as at time $t_5$, again via half-select signals applied to conductor pair $R_1$, $C_1$. The magnitude $V_e$ of pulse EP is sufficient to create a discharge in conjunction with the stored wall voltage, as the following positive sustain pulse PS would have. Wall voltage $e_m$ thus begins to reverse polarity. However, the magnitude and duration of erase pulse EP are such that the wall voltage reversal is terminated prematurely, at time $t_6$, when the wall voltage magnitude is near zero. Accordingly, no further discharges occur, and site $S_{11}$ returns to a non-light-emitting state. Any residuum of wall voltage $e_m$ eventually disappears due to recombination of the positive and negative charge carriers and diffusion thereof away from the display site.

Fabrication of the prior art plasma panel of FIGS. 1 and 2 proceeds in steps. In accordance with a typical such process, conductors $R_j$ are first formed in the desired pattern on the surface of substrate 11 using a glass-/gold frit. The panel is then fired at high temperature to harden the frit.

A first portion of dielectric layer 12 having holes for vias $V_{ij}$ is then formed. This step may be accomplished in at least two ways. A dielectric slurry may be screened over the substrate and row conductors leaving holes for the vias. The slurry is then fired. Alternatively, the slurry may be screened and fired without the via holes. The latter are then created by introducing an etchant through appropriately-located holes in a photoresist mask formed on the dielectric. The mask is then stripped away.

Subsequent steps complete the fabrication process, with the panel being fired at each step to harden the applied material. These steps include filling of the via holes with glass/gold frit, formation of pads $P_{ij}$ and conductors $C_i$ on the dielectric thus far deposited, and application of a final portion of dielectric. The latter is covered with one or more thin film oxide layers. The cavity in which gas 14 is enclosed is then formed by sealing all edges of cover plate 15 with a glass solder seal.

The requirement that a planar ac plasma panel include vias as described above makes it difficult to fabricate a panel in which all display sites are formed correctly and have relatively uniform characteristics, e.g., uniform firing voltage, brightness, etc. For example, if the vias holes are formed using the first of the above-mentioned methods, the openings in the dielectric slurry tend to close up when the panel is fired. This problem can be alleviated to some extent by adding a mineral filler to the slurry to stiffen it. However, this prevents the slurry from flowing evenly, resulting in a rough dielectric surface. This, in turn, can result in uneven capacitances between the upper layer electrodes and the upper dielectric surface, causing nonuniform display site characteristics.

The mineral filler also serves the function of preventing the dielectric from remelting when the panel is fired during subsequent fabrication steps. Thus, even if the via holes are formed in accordance with the second of the above-described techniques, i.e., etching, a rough dielectric surface may result. This, again, not only leads to uneven capacitances, but also causes difficulties in etching the via holes.

In particular, the roughness of the dielectric surface precludes good contact between that surface and the mask used to expose the photoresist. This can cause pin holes in the latter and can also lead to irregularly shaped openings in the photoresist. The existence of pin holes, of course, means that the dielectric will be etched in places not desired. Moreover, the irregularly shaped openings increase the possibility that the upper rim of the via will be formed too close to the associated upper level, column conductor. This, again, can cause nonuniform display site characteristics and, in an extreme case, may result in a pad/column conductor short circuit. Indeed, even with properly shaped openings in the photoresist, the etchant tends to spread out under the photoresist layer, enlarging the hole and giving rise to the same problems.

There are further complications. For example, when the frit used to fill the via holes is fired, it tends to shrink into the hole. This can cause uneven dielectric thickness over the pad electrodes, once again resulting in uneven display site characteristics. Moreover, via hole formation requires very precise alignment of the screens and/or masks used to form them. This, in general, further adds to the complexity and/or expense of the fabrication process.

In accordance with the present invention, we have discovered that a planar ac plasma panel can be fabricated without the conductive vias used in the prior art, thereby avoiding the above-described and other problems. In particular, the panel is fabricated so as to provide substantial capacitive coupling between each row conductor and each of its associated pads. That is, the impedance between each row conductor and its associated pads is substantially capacitive. Signals on the row conductors are thus coupled to the pads capacitively, rather than ohmically, as in the prior art.

Figure 4:
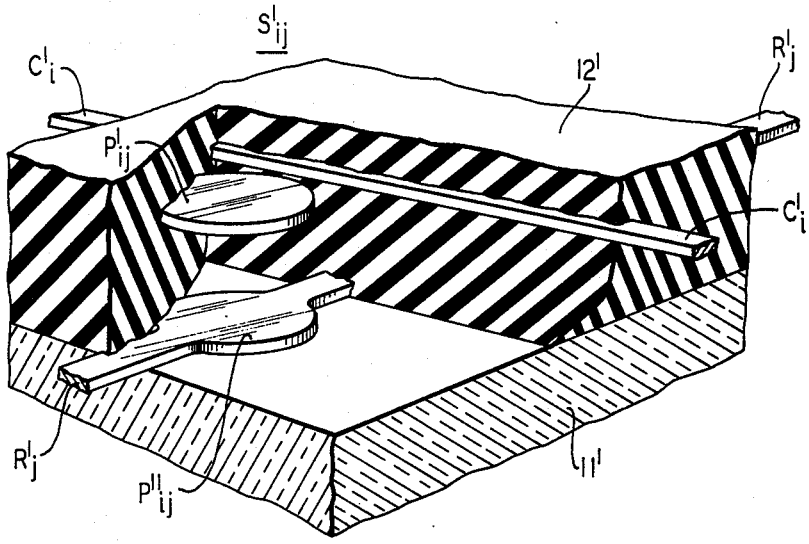
FIG. 4 is a perspective view of a display site of a planar ac plasma display panel embodying the principles of our invention.

FIG. 4 shows a perspective, partial cutaway view (without the cover plate) of an individual display site $S_{ij}'$ of a planar ac plasma panel embodying the principles of our invention. The panel includes a substrate 11' and dielectric layer 12'. Display site $S_{ij}'$ includes a pad $P_{ij}'$ disposed near the intersection of row and column conductors $R_j'$ and $C_i'$. Conductors $R_j'$ and $C_i'$ and pad $P_{ij}'$ correspond generally to individual conductors $R_j$ and $C_i$ and an individual pad $P_{ij}$ of prior art panel 10. However, there are no vias connecting pad $P_{ij}'$ to conductor $R_j'$. Rather, signals on conductor $R_j'$ are coupled to pad $P_{ij}'$ capacitively, as previously indicated. Pad $P_{ij}'$ is illustratively round. This ensures that discharges occur at corresponding points on each pad since discharges will occur where the pad/column conductor gap is the smallest. This, in turn, ensures that the same spacing occurs between discharge points in each column. The capacitive coupling mechanism which forms the basis of our invention is not dependent on the pad shape, however.

Figure 5:
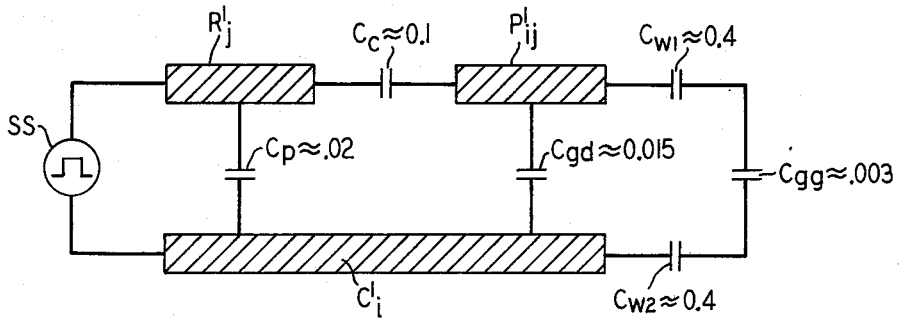
FIG. 5 shows the equivalent circuit of the display site of FIG. 4.

FIG. 5 shows an equivalent circuit of site $S_{ij}'$, which is helpful in illustrating the principles of our invention. Each of the capacitances in the equivalent circuit represents the capacitance between respective pairs of points in the display site. These include $C_p$, the capacitance between conductors $R_j'$ and $C_i'$; $C_c$, the capacitance through dielectric layer 12' between conductor $R_j'$ and pad $P_{ij}'$; $C_{gd}$, the capacitance between pad $P_{ij}'$ and conductor $C_i'$; $C_{w1}$, the capacitance between pad $P_{ij}'$ and the dielectric 12'/gas interface; $C_{w2}$, the capacitance between conductor $C_i'$ and the dielectric 12'/gas interface; and $C_{gg}$, the capacitance through the display gas from the surface of layer 12' above pad $P_{ij}'$ to the surface of layer 12' above conductor $C_{11}'$. The equivalent circuit also includes a signal source, SS, illustratively the write source, connected between the row and column conductors.

It will be appreciated that in order for display site $S_{ij}'$, which has no vias, to operate substantially like a display site of prior art panel 10, which does have vias, the voltage drop between conductor $R_j'$ and pad $P_{ij}'$ must be small, just as the drop across vias $V_{ij}$ of panel 10 is small. Thus, as seen from FIG. 5, the value of capacitance $C_c$ must be large as compared to that of capacitance $C_{gd}$ taken in parallel with the series combination of capacitances $C_{w1}$, $C_{gg}$ and $C_{w2}$.

To this end, the value of capacitance $C_c$ may be made large in accordance with a feature of the invention by forming row conductor $R_j'$ such that it has a widened region, or pad, $P_{ij}''$ which lies directly below, and is illustratively the same shape as, pad $P_{ij}'$. Typical values for the capacitances of the equivalent circuit are shown in FIG. 5. These values are rough calculations arrived at assuming the following physical parameters: Width of conductors $R_j'$ and $C_i'$, 0.003"; diameter of pads $P_{ij}'$ and $P_{ij}''$, 0.010"; width of the gap between conductor $C_i'$ and pad $P_{ij}'$, 0.003"; total thickness of dielectric layer 12', 0.002"; and distance between upper and lower electrode levels within dielectric layer 12', 0.0015". The values of capacitances $C_{w1}$ and $C_{w2}$, which vary as a function of the amount of wall charge stored, are given at their maximum. The equivalent capacitance of the network comprised of capacitances $C_{gd}$, $C_{w1}$, $C_{w2}$ and $C_{gg}$ is substantially equal to the value of capacitance $C_{gd}$, which in this example is approximately 0.015 pf. As shown in FIG. 5, the value of capacitance $C_c$ is approximately ten times greater than that of capacitance $G_{gd}$. Thus, the potential on pad $P_{ij}'$ is substantially equal to that on conductor $R_j'$ (or pad $P_{ij}''$). It is thus seen that the function provided by conductive vias in prior art planar ac plasma panels is provided in accordance with present invention without the need for those vias.

The present invention provides a further advantage over the prior art. Glows created at an ON site of a planar ac plasma panel tend to propagate, or spread, away from the gap in response to each sustain pulse, storing wall charge at the dielectric surface at points further and further away from the gap as the glow spreads. This mechanism may be advantageous in some applications. See, for example, the copending U.S. patent application of G. W. Dick, Ser. No. 759,892, filed Jan. 17, 1977, now U.S. Pat. No. 4,106,009 issued Aug. 8, 1978. However, it is disadvantageous in matrix array panels, because it can lead to erroneous ignition of nearby OFF sites. Advantageously, the presence of fixed capacitor $C_c$ precludes untoward glow spreading. This is because current continues to flow between conductor $R_j'$ and pad $P_{ij}'$ as the glow begins to spread, storing more and more charge on capacitance $C_c$. This creates an increasingly large voltage drop across that capacitance. The polarity of this drop is such as to reduce the voltage drop in the gas and beyond a certain point, the voltage drop in the gas is insufficient to allow further discharges in response to the present sustain pulse. Accordingly, glow propagation ceases. This mechanism does not come into play in prior art panel 10 since wall capacitances $C_{w1}$ and $C_{w2}$, on which all the accumulated charge is stored, do not have values which are fixed but, rather, have values which increase as the stored charge increases. Thus, the voltage drop thereacross does not increase and glow spreading is not inhibited.

Figure 6:
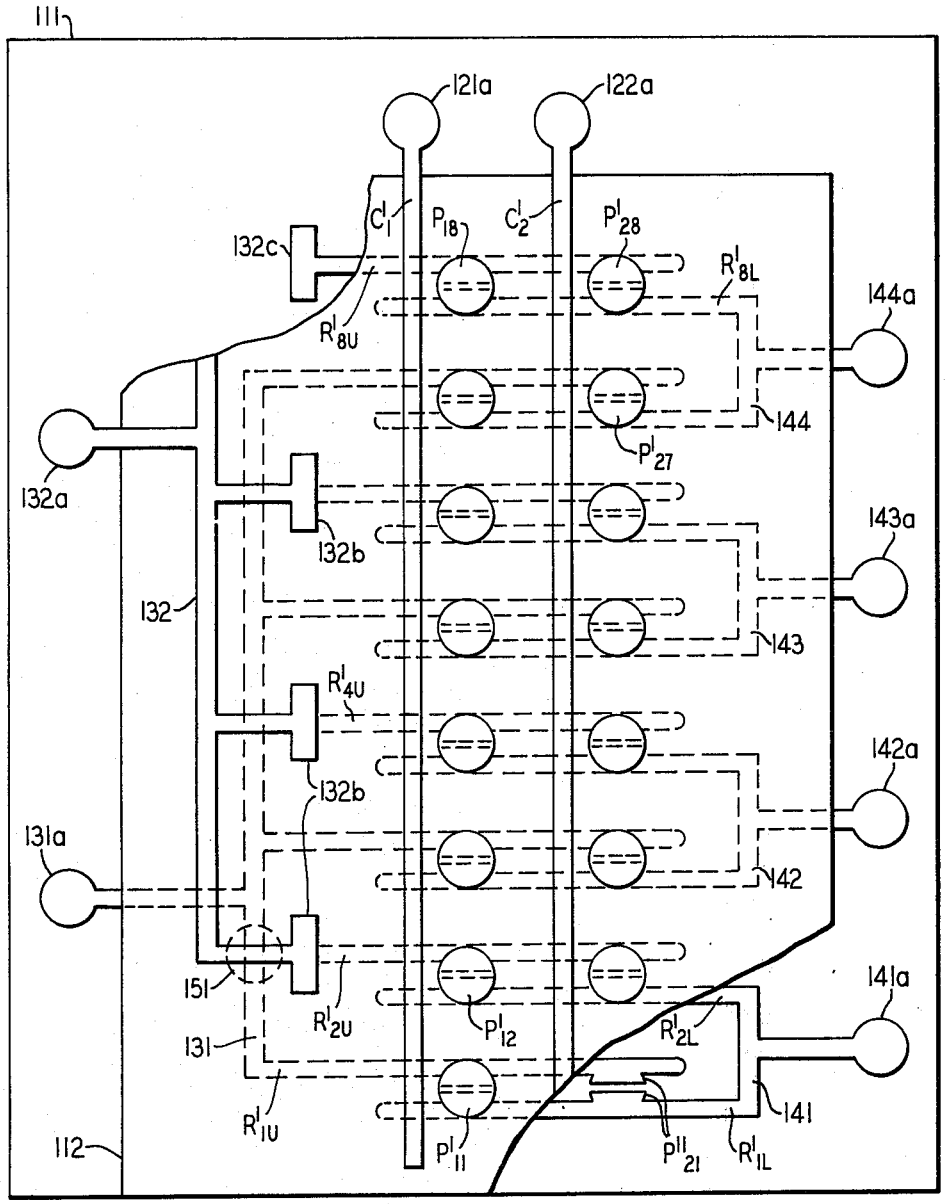
FIG. 6 is a partial cutaway top view of a specific embodiment of a planar ac plasma display panel embodying the principles of our invention. This panel includes an advantageous site addressing arrangement in accordance with a feature of the invention.

FIG. 6 is a top, partial cutaway view of a planar ac plasma panel embodying the principles of our invention. The panel is comprised of a 2×8 array of capacitively-coupled display sites similar to site $S_{ij}'$ of FIG. 4. The panel includes a substrate 111 and dielectric layer 112 disposed thereon. Embedded in the latter are upper level column conductors $C_1'$ and $C_2'$ and pads $P_{11}'$–$P_{28}'$. Conductors $C_1'$ and $C_2'$ extend beyond the edge of dielectric layer 112 down onto substrate 111 where they terminate in external contacts 121*a* and 122*a*.

In accordance with a feature of the invention, the lower level electrodes and pads are arranged so as to minimize the number of external connections and the amount of driver circuitry needed to operate the panel. In particular, two row conductors are provided for each row of display sites. The row conductors are arranged in first and second pluralities which are substantially parallel to and interleaved with each other. Each display site has an associated row conductor from each of the two pluralities over which the upper level pad of that site is disposed.

Thus in FIG. 6, the row conductors include a first plurality of row conductors $R_{1L}'$, $R_{2L}'$, etc. and a second plurality of row conductors $R_{1u}'$, $R_{2u}'$, etc. Pad $P_{11}'$, by way of example, is disposed over row conductors $R_{1L}'$ and $R_{1u}'$. The lower level pad for each display site—corresponding generally to pad $P_{ij}''$ in FIG. 4—is divided into halves, each half being a part of one of the two associated row conductors. This is explicitly shown in the lower left cutaway portion of FIG. 6 for lower level pad $P_{21}''$. (In order to minimize the voltage drop between the levels, the total capacitance between each upper level pad and the two associated lower level pads should be substantially greater than the capacitance between that upper level pad and the associated column conductor.)

In the general case in which the display panel has m×n rows, the first-plurality conductors are interconnected in m groups each having n interconnected conductors and the second-plurality conductors are interconnected in n groups of m interconnected conductors, $m \geqq 2$, $n \geqq 2$. In FIG. 6, in particular, the first-plurality row conductors are interconnected by way of conductors 141–144 into four groups of two adjacent conductors each. Thus, for example, row conductors $R_{1L}'$ and $R_{2L}'$ are interconnected by conductor 141. The four groups have respective associated contacts 141*a*–144*a* which extend from conductors 141–144 out beyond the edge of dielectric layer 112 onto substrate 111. The second-plurality row conductors are interconnected in two groups of four conductors each. The odd-numbered row conductors $R_{1u}'$, $R_{3u}'$, etc., comprising the first group have an associated contact 131*a* which extends from a conductor 131. The even-numbered row conductors $R_{2u}'$, $R_{4u}'$, etc., comprising the second group have an associated contact 132*a* which extends from a conductor 132.

A potential problem exists with an arrangement such as shown in FIG. 6 in that conductors 131*a* and 132*a* must be insulated from each other where they cross, such as at point 151. This problem is illustratively overcome by placing conductor 132 at the upper level within dielectric layer 112 (i.e., at the same level as conductors $C_1'$ and $C_2'$ and pads $P_{11}'$–$P_{28}'$) while conductor 131 is at the lower level. Signals on conductor 132 are then coupled to row conductors $R_{2u}'$, $R_{4u}'$, etc., down through dielectric layer 112. This may be achieved by way of conventional conductive vias. Alternatively, as illustrated in FIG. 6, signals on conductor 132 can be coupled to row conductors $R_{2u}'$, $R_{4u}'$, etc., capacitively. To this end, conductor 132 is provided with terminating pads 132*b*, while similar pads 132*c* are provided directly below pads 132*b* at the ends of row conductors $R_{2u}'$, $R_{4u}'$, etc. An individual one of pads 132*c* is visible in the upper right cutaway portion of FIG. 6. Pads 132*b* and 132*c*, and thus the capacitance between them, should be made sufficiently large to avoid untoward voltage drop across the dielectric, i.e., roughly at least as large as the lower-level display pad area which they feed.

In operation, the row half-select portion of, for example, write and erase signals to be applied to any display site is applied to the two row conductors associated with that site. As before, the column half-select portion of the signal is applied to the associated column conductor. In this way, only the selected site receives a full write or erase signal. For example, a write signal is applied to the site which includes pad $P_{11}'$ by applying a pulse of magnitude $+V_w/2$ to contacts 131*a* and 141*a*, and a pulse of magnitude $-V_w/2$ to contact 121*a*. Conductors associated with unselected sites are held at ground or other, more negative, reference level. Note that since row addressing signals are applied to groups of row conductors rather than to individual row conductors, the number of external connections and the amount of driver circuitry needed to operate the panel are minimized. In general, a panel with (m×n) rows requires only (m+n) external connections and (m+n) drivers. Of genral interest is U.S. Pat. No. 3,993,921 issued Nov. 23, 1976 to F. N. H. Robinson which discloses a similar approach for twin-substrate ac plasma panels.

The following is an exemplary procedure for fabricating a planar ac plasma panel in accordance with our invention: The lower level conductors are formed on a glass substrate using a glass/gold frit such as the frit sold by E. I. DuPont deNemours & Co. under the trademark Fodel. The standard drying, exposing, developing and firing steps recommended by the manufacturer in creating the desired conductor pattern may be followed.

A dielectric slurry such as Electro-Science Labs M4111C is then used to form a 1.5 mil thick portion of dielectric. The dielectric is built up in three layers; we have discovered that this facilitates a smooth surface on which to form the upper layer conductors and pads. A first layer is formed by screening the slurry through a 200 mesh screen. The ends of the conductors are left exposed on one side to allow external electrical connections thereto. The panel is then fired at a peak temperature of 608° C. for a time which is dependent on the size of the panel being formed. We have found that a firing time of 15–20 minutes at the peak temperature is required for a 1½ inch square panel. The above screening and firing steps are repeated to form a second layer. A third layer of dielectric is then applied using a 325 mesh screen to further ensure a smooth surface. The panel is then fired as before. This third layer is somewhat smaller in length and width than the preceding two in order to provide a more gradual slope from its surface down to the substrate.

The upper layer conductors and pads are then formed on the dielectric again using Fodel frit. The conductors are made to extend beyond one edge of the dielectric down onto the substrate. Providing the above-mentioned gradual slope at the dielectric edge helps ensure conductor continuity.

A final 0.4 mil portion of dielectric is now formed over the upper level conductors and pads, again leaving the conductor ends exposed for ultimate electrical connection. The material used to form this layer must have a number of properties. It must provide a very smooth surface in order to receive a thin film oxide layer to be applied later. In addition, it must not soften when the glass cover plate is sealed onto the panel. However, it must not require such a high firing temperature as to cause the structure already formed to soften, melt or evaporate. One material meeting all these criteria is #9543 overglaze manufactured by E. I. DuPont deNemours & Co., which is applied through a 200 mesh screen and fired at 590° C. for 15–20 minutes at peak (for a 1½ inch square panel).

A gas fill hole is drilled in the substrate and a 6.0 mil layer of glass solder seal such as #7555 seal manufactured by Corning Glass is applied around the periphery of the substrate and the hole. A 1000 A layer of CeO, and a 2000 A layer of MgO are then successively applied over the panel using, for example, electron beam evaporation. The top cover plate is then positioned over the panel and the two inch hollow tube positioned on the gas fill hole. The panel is then fired at 450° C. for 23 minutes at peak temperature to seal the top cover plate and the tube.

Finally, the panel is filled through the glass tube with a conventional neon-argon gas mixture and the tube is sealed off.

Although particular embodiments of our invention and a particular process for fabricating same are shown and described herein, it will be appreciated that these merely illustrate the invention and a manner of making it. Numerous other arrangements embodying the principles of the invention and numerous other processes for fabricating same may be devised by those skilled in the art without departing from the spirit and scope of the invention.

We claim:

1. Display apparatus comprising a body of ionizable gas, a dielectric layer, means for containing said gas adjacent to said dielectric layer, at least first and second electrodes embedded in said layer at first and second levels therewithin, respectively, said second level being more proximate to said body of ionizable gas than said first level, and a third electrode disposed in said layer at said second level directly above said first electrode and adjacent to said second electrode, characterized in that said first and third electrodes are formed so as to provide substantial capacitive coupling therebetween.

2. The invention of claim 1 further characterized in that said first electrode includes a portion which is substantially the same shape as, and which lies directly below, said third electrode.

3. The invention of claim 2 wherein said first and second electrodes are elongate and disposed substantially at right angles to one another.

4. Display apparatus comprising a substrate, a layer of a dielectric material disposed on said substrate, first and second pluralities of elongate conductors embedded in said layer of dielectric material at first and second levels, respectively, the conductors of said first plurality being substantially perpendicular to the conductors of said second plurality, a plurality of second-level conductive pads, each of said pads being embedded in said layer of dielectric material at said second level over an associated one of said first plurality conductors and adjacent an associated one of said second plurality conductors, a body of display gas, and means for containing said gas adjacent to said dielectric layer, characterized in that the region between each of said pads and the associated one of said first plurality conductors is exclusively comprised of said dielectric material.

5. The invention of claim 4 wherein the impedance between each of said second-level pads and its associated first plurality conductor is substantially capacitive.

6. The invention of claim 5 wherein said display apparatus is formed such that the capacitance between each one of said second-level pads and the associated first plurality conductor is substantially greater than the capacitance between said one of said second-level pads and its associated second plurality conductor.

7. The invention of claim 5 or claim 6 further characterized in that each of said first plurality conductors is comprised of a plurality of first-level conductive pads each of which has substantially the same area as, and is disposed directly below, an individual one of said second-level pads and means for interconnecting said first-level pads.

8. Display apparatus comprising a substrate, a layer of dielectric material disposed on said substrate, first and second pluralities of elongate conductors embedded in said layer of dielectric material at a first level, the conductors of said first and second pluralities being substantially parallel to and interleaved with each other, a third plurality of elongate conductors embedded in said layer of dielectric material at a second level, the conductors of said third plurality being substantially perpendicular to the conductors of said first and second pluralities, a plurality of second-level conductive pads, each of said second-level pads being embedded in said layer of dielectric material at said second level over an associated one of said first plurality conductors, over an associated one of said second plurality conductors, and adjacent an associated one of said third plurality conductors, means for interconnecting the conductors of said first plurality in m groups each having n interconnected conductors, $m \geqq 2$, $n \geqq 2$, means for interconnecting the conductors of said second plurality in n groups each having m interconnected conductors, a body of display gas, and means for containing said gas adjacent to said layer of dielectric material, characterized in that the region between each of said second-level pads and the associated ones of said first and second plurality conductors is exclusively comprised of said dielectric material.

9. The invention of claim 8 wherein the impedance between each of said second-level pads and its associated first and second plurality conductors is substantially capacitive.

10. The invention of claim 9 wherein said display apparatus is formed such that the total capacitance between each one of said second level pads and its associated first and second plurality conductors is substantially greater than the capacitance between said one of said second-level pads and its associated third plurality conductor.

11. The invention of claim 9 or claim 10 further characterized in that each of said first and second plurality conductors is comprised of a plurality of first-level conductive pads each of which has substantially half as much area as, and is disposed directly below, an individual one of said second-level pads and means for interconnecting said first-level pads.

* * * * *